US006736213B2

(12) United States Patent
Bussear et al.

(10) Patent No.: US 6,736,213 B2
(45) Date of Patent: May 18, 2004

(54) METHOD AND SYSTEM FOR CONTROLLING A DOWNHOLE FLOW CONTROL DEVICE USING DERIVED FEEDBACK CONTROL

(75) Inventors: Terry Bussear, Round Rock, TX (US); Walter Going, Houston, TX (US); David Schneider, Conroe, TX (US); Mike Norris, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 20 days.

(21) Appl. No.: 10/282,801

(22) Filed: Oct. 29, 2002

(65) Prior Publication Data

US 2003/0132006 A1 Jul. 17, 2003

Related U.S. Application Data

(60) Provisional application No. 60/340,948, filed on Oct. 30, 2001.

(51) Int. Cl.[7] ..... E21B 34/16

(52) U.S. Cl. ..... 166/375; 166/319; 166/320; 166/386

(58) Field of Search ..... 166/375, 374, 166/386, 66, 250.01, 319, 320, 321, 65.1

(56) References Cited

U.S. PATENT DOCUMENTS 5,251,703 A * 10/1993 Skinner ..... 166/374
5,273,112 A 12/1993 Schultz
5,355,960 A 10/1994 Schultz et al.
5,547,029 A 8/1996 Rubbo et al.
6,179,052 B1 1/2001 Purkis et al.
6,543,544 B2 * 4/2003 Schultz et al. ..... 166/373
6,585,051 B2 * 7/2003 Purkis et al. ..... 166/374

* cited by examiner

*Primary Examiner*—Hoang Dang
(74) *Attorney, Agent, or Firm*—Madan, Mossman & Sriram, P.C.

(57) ABSTRACT

A system and methods for proportionally controlling hydraulically actuated downhole flow control devices using derived feedback control. The system comprises a downhole flow control device with a moveable element in a stationary housing. The moveable element is actuated by a balanced hydraulic piston. Hydraulic lines are fed to either side of the piston to effect actuation in either direction. A processor controlled, surface mounted hydraulic system supplies fluid to the piston. A pressure sensor measures supply pressure to the piston and a cycle counter indicates pump cycles and both sensors generate outputs to the processor. The downhole moveable element is cycled between end stops until successive moveable element breakout pressures are within a predetermined value as measured by the surface pressure sensor. A relationship is then derived between moveable element movement and pumped fluid volume and the relationship is used to move the moveable element to a predetermined position to control flow.

25 Claims, 3 Drawing Sheets

PROCESSOR
60
44
43
50
55
42
40
65
41
45
35
PD
PUMP
RESERVOIR
5
1
25
30
10
15
20
A
22
15
B

METHOD AND SYSTEM FOR CONTROLLING A DOWNHOLE FLOW CONTROL DEVICE USING DERIVED FEEDBACK CONTROL

CROSS-REFERENCE TO RELATED APPLICATION

This application claims the benefit of U.S. Provisional Application No. 60/340,948 filed on Oct. 30, 2001.

BACKGROUND OF THE INVENTION

1. Field of the Invention

This invention relates generally to a method for the control of oil and gas production wells. More particularly, it relates to proportional control of movable elements in well production flow control valves.

2. Description of the Related Art

The control of oil and gas production wells constitutes an on-going concern of the petroleum industry due, in part, to the enormous monetary expense involved in addition to the risks associated with environmental and safety issues. Production well control has become particularly important and more complex in view of the industry wide recognition that wells having multiple branches (i.e., multilateral wells) will be increasingly important and commonplace. Such multilateral wells include discrete production zones which produce fluid in either common or discrete production tubing. In either case, there is a need for controlling zone production, isolating specific zones and otherwise monitoring each zone in a particular well. Flow control devices such as sliding sleeve valves, downhole safety valves, and downhole chokes are commonly used to control flow between the production tubing and the casing annulus. Such devices are used for zonal isolation, selective production, flow shut-off, commingling production, and transient testing.

These tools are typically actuated by hydraulic systems or electric motors driving a member axially with respect to a tool housing. Hydraulic actuation can be implemented with a shifting tool lowered into the tool on a wireline or by running hydraulic lines from the surface to the downhole tool. Electric motor driven actuators may be used in intelligent completion systems controlled from the surface or using downhole controllers.

The surface controllers are often hardwired to downhole sensors which transmit information to the surface such as pressure, temperature and flow. It is also desirable to know the position of the movable members, such as, for example, the sliding sleeve in a sliding sleeve valve, in order to better control the flow from various zones. Originally, sliding sleeves were actuated to either a fully open or fully closed position. To control an open-closed, hydraulically actuated flow control device, it is sufficient to provide a simple open loop control system. The principal problem with this arrangement is that there is no way to confirm that the device has actually performed the desired action. To obviate this problem, sensors are placed downhole to directly sense the position of the device.

To implement a valve with proportional control, a closed loop feedback control system is used. The proportional control allows the valve to function in a choking mode which is desirable when attempting to commingle multiple producing zones that operate at different reservoir pressures. This choking prevents crossflow, via the wellbore, between downhole producing zones. The closed loop system typically requires sensors and control system electronics to be mounted downhole. However, the combination of high pressure and high temperature act to reduce the effective lifespan of the downhole electronics and reduce the reliability of the overall system. It is highly desirable to reduce or eliminate the complex system of downhole sensors and electronics.

What is desired is a simple proportional control system. An obvious solution is the use of an open-loop control system. This would be possible if the controlled devices and sensors did not degrade and change with time. In the case of a hydraulically powered sliding sleeve valve, the valve experiences several changes over time. For example, hydraulic fluid ages and exhibits reduced lubricity with exposure to high temperature; scale and other deposits will occur in the interior of the valve; and seals will degrade and wear with time. For a valve to act effectively as a choke, it needs a reasonably fine level of controllability. The potential changes to the system components prevent that controllability with an open-loop control system.

Thus there is a need for a simple proportional hydraulic actuation system for downhole flow control devices which can determine the position of a downhole movable member using surface located control and feedback components. The system must be able to adapt to and compensate for the exposure related changes to the downhole system.

The methods and apparatus of the present invention overcome the foregoing disadvantages of the prior art by providing a system and methods for effecting the simplicity of an open loop control system and the controllability of a closed loop system by adaptively determining system response changes over time using surface located sensors and controlling proportional valve movement based on the revised system response.

SUMMARY OF THE INVENTION

The present invention contemplates a surface located system and sensors for deriving appropriate feedback control parameters to effect proportional control of a downhole hydraulically actuated flow control device.

In one preferred embodiment, a system for controlling a downhole flow control device comprises an hydraulically actuated flow control device in a production string. The flow control device has a movable element for controlling the downhole formation flow. A hydraulic system is hydraulically coupled to the hydraulically actuated flow control device and supplies hydraulic fluid to the hydraulically actuated flow control device. At least one sensor detects at least one parameter of interest related to a volume of hydraulic fluid supplied to the hydraulically actuated flow control device and generates a first signal related thereto. At least one pressure sensor determines a hydraulic fluid supply pressure and generates a second signal related thereto. A processor receives the first signal and the second signal and acts according to programmed instructions to generate a relationship between a position of the moveable element and the volume of supplied hydraulic fluid and controls the hydraulic system to position the spool at a predetermined position according to the relationship.

In a second preferred embodiment, a system for controlling a downhole flow control device comprises an hydraulically actuated flow control device in a production string, where the flow control device has a movable element for controlling the downhole formation flow. A hydraulic system is hydraulically coupled to the hydraulically actuated flow control device for supplying hydraulic fluid to the hydraulically actuated flow control device. At least one sensor detects at least one parameter of interest related to a volume of hydraulic fluid supplied to the hydraulically actuated flow control device and generates at least one first signal related thereto. At least one pressure sensor for determining a hydraulic fluid supply pressure and generating at least one second signal related thereto. A hydrophone disposed in a hydraulic line detects a pressure pulse in response to movement of the spool and generates a third signal in response thereto. A processor receiving said first signal, said second signal, and said third signal and acting according to programmed instructions to generate a relationship between a position of the spool and the volume of supplied hydraulic fluid and controls the hydraulic system to position the moveable element at a predetermined position according to the relationship.

In another preferred embodiment, a method for control of a hydraulically actuated, downhole flow control device comprises cycling a moveable element in the hydraulically actuated downhole flow control device in a first direction and a second opposite direction. A breakout pressure is determined for each actuation cycle using a pressure sensor. The device is cycled until the breakout pressure on successive cycles is within a predetermined difference while measuring the pumped fluid volume for each cycle or until a predetermined number of cycles have occurred. A processor generates a relationship characterizing the movement of the moveable element as a function of a pumped fluid volume and controls the supply of fluid required according to said relationship to move said moveable element to a predetermined position.

In another preferred embodiment, a method for control of a hydraulically actuated, downhole flow control device comprises cycling a moveable element in the hydraulically actuated downhole flow control device in a first direction and a second opposite direction. A breakout pressure is determined for each actuation cycle using a pressure sensor and a hydrophone. The device is cycled until the breakout pressure on successive cycles is within a predetermined difference while measuring the pumped fluid volume for each cycle. A processor generates a relationship characterizing the movement of the spool as a function of a pumped fluid volume and controls the supply of fluid required according to said relationship to move said moveable element to a predetermined position.

In another preferred embodiment, a method for proportional control of a hydraulically actuated, downhole flow control device, comprises supplying hydraulic fluid to an actuator cooperatively coupled to a spool in the hydraulically actuated downhole flow control device through a first line and a second line. The first line and the second line are pressured to the same predetermined pressure. A first measured volume of hydraulic fluid is bled from the second line causing the actuator to move the spool. A second measured volume of hydraulic fluid is supplied to the first line until the first line is at the predetermined pressure. A volume difference is determined between the second measured volume and the first measured volume. A surface located processor is used to generate a relationship between the volume difference and the spool movement. The relationship is used to move said moveable element to a predetermined position.

In another preferred embodiment, a method for proportional control of a hydraulically actuated, downhole flow control device, comprises supplying hydraulic fluid to an actuator cooperatively coupled to a spool in the hydraulically actuated downhole flow control device through a first line and a second line. The first line and the second line are pressured to the same predetermined pressure. A first measured volume of hydraulic fluid is bled from the second line causing the actuator to move the spool. A second measured volume of hydraulic fluid is supplied to the first line until the second line is at the predetermined pressure. The first line pressure is then adjusted to the predetermined pressure and a volume difference is determined between the second measured volume and the first measured volume. A surface located processor is used to generate a relationship between the volume difference and the spool movement. The relationship is used to move said moveable element to a predetermined position.

Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, reference should be made to the following detailed description of the preferred embodiment, taken in conjunction with the accompanying drawings, in which like elements have been given like numerals, wherein.

DESCRIPTION OF PREFERRED EMBODIMENTS

As is known, a given well may be divided into a plurality of separate zones which are required to isolate specific areas of a well for purposes of producing selected fluids, preventing blowouts and preventing water intake.

Figure 1:
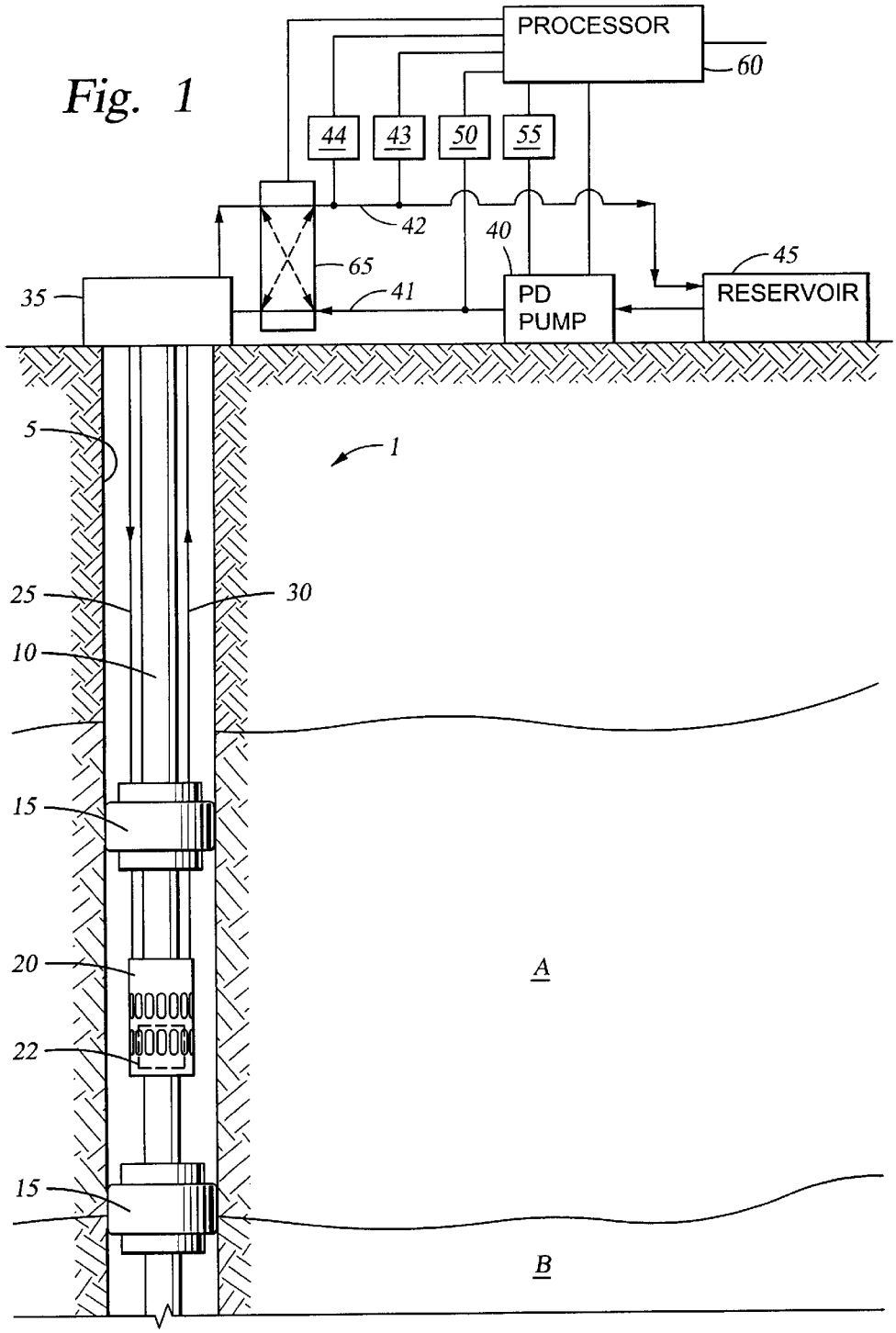
FIG. 1 is a schematic of a production well flow control system according to one embodiment of the present invention.

With reference to FIG. 1, well 1 includes two zones, namely zone A and zone B where the zones are separated by an impermeable barrier. Each of zones A and B have been completed in a known manner. FIG. 1 shows the completion of zone A using packers 15 and sliding sleeve valve 20 supported on tubing string 10 in wellbore 5. The packers 15 seal off the annulus between the wellbore and a flow control device, such as sliding sleeve valve 20, thereby constraining formation fluid to flow only through an open sliding sleeve valve 20. Alternatively, the flow control device may be any flow control device having at least one moveable element for controlling flow, including, but not limited to, a downhole choke and a downhole safety valve. As is known in the art, a common sliding sleeve valve employs an outer housing with slots, also called openings, and an inner spool with slots. The slots are alignable and misalignable with axial movement of the inner spool relative to the outer housing. Such devices are commercially available. The tubing string 10 is connected at the surface to wellhead 35.

In a preferred embodiment, the sliding sleeve valve 20 is controlled from the surface by two hydraulic control lines, an opening line 25 and closing line 30 that operate a balanced, dual acting, hydraulic piston (not shown) in the sliding sleeve 20 which shifts a moveable element, such as inner spool 22, also called a sleeve, to align or misalign flow slots, or openings, allowing formation fluid to flow through the sliding sleeve valve 20. Multiple configurations of the moveable element are known in the art, and are not discussed herein. Such a device is commercially available as HCM Hydraulic Sliding Sleeve from Baker Oil Tools, Houston, Tex. In operation, line 25 is pressurized to open the sliding sleeve valve 20, and line 30 is pressurized to close the sliding sleeve valve 20. During a pressurization of either line 25 or 30, the opposite line is controllably vented by valve manifold 65 to the surface reservoir tank 45. The line 25 and 30 are connected to a positive displacement pump 40 and the return reservoir 45 through valve manifold 65 which is controlled by processor 60. The pump 40 takes hydraulic fluid from reservoir 45 and supplies it under pressure to line 41. Pressure sensor 50 monitors the pressure in pump discharge line 41 and provides a signal to processor 60 related to the detected pressure. The cycle rate or speed of pump 40 is monitored by pump cycle sensor 55 which sends an electrical signal to processor 60 related to the number pump cycles. The signals form sensors 55 and 50 may be any suitable type of signal, including, but not limited to, optical, electrical, pneumatic, and acoustic. Alternatively, a positive displacement flowmeter (not shown) can be installed in pump discharge line 41 to measure the flow directly. By its design, a positive displacement pump discharges a determinable fluid volume for each pump cycle. By determining the number of pump cycles, the volume of fluid pumped can be determined and tracked. Valve manifold 65 acts to direct the pump output flow to the appropriate hydraulic line 25 or 30 to move spool 22 in valve 20 in an opening or closing direction, respectively, as directed by processor 60. Processor 60 contains suitable interface circuits and processors, acting under programmed instructions, to provide power to and receive output signals from pressure sensor 50 and pump cycle sensor 55; to interface with and to control the actuation of manifold 65 and the cycle rate of pump 40; and to analyze the signals from the pump cycle sensor 55 and the pressure sensor 50 and to issue commands to the pump 40 and the manifold 65 to control the position of the spool 22 in the sliding sleeve valve 20 between an open position and a closed position.

Figure 2:
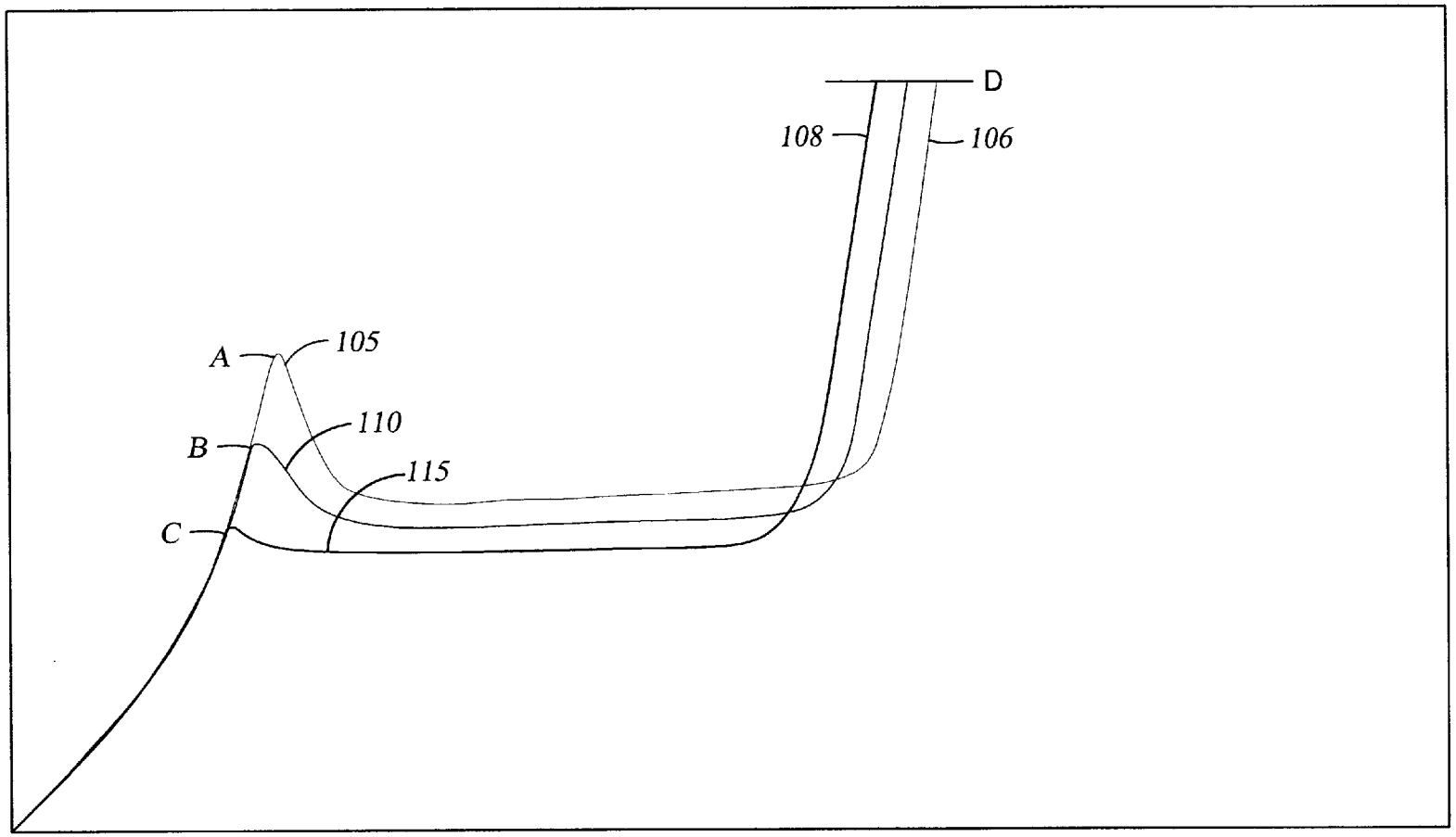
FIG. 2 is a schematic of pressure sensor output vs. pumped fluid volume during cycling of a flow control device according to one embodiment of the present invention; and, FIG. 3 is a schematic of pressure sensor output and hydrophone output vs. pumped fluid volume during cycling of a flow control device according to one embodiment of the present invention.

In operation, the sliding sleeve valve 20 is traditionally operated in so that the valve openings are placed in a fully open or fully closed condition. As previously noted, however, it is desirable to be able to proportionally actuate such a device to provide intermediate flow conditions that can be used to choke the flow of the reservoir fluid. Ideally, the pump could be operated to supply a known volume of fluid which would move the spool 22 a determinable distance. However, the effects of stiction and friction cause significant changes in the response, over time, of such a downhole flow control device. As used herein, the term "stiction" refers to the static frictional forces opposing motion which must be overcome to initiate motion. The magnitude of these forces change, and typically increase, the longer the spool 22 remains in a fixed position. Stiction arises from scale deposits on sliding surfaces within the valve. In addition, elastomeric seals are commonly used in such devices and the elastomer tends to drape or conform to the surface irregularities increasing the seal to metal contact area and requiring greater forces to break free. These effects can be seen in FIG. 2, which shows the response of pressure sensor 50 as fluid is pumped to move the spool 22. When the spool 22 has been at a set position for an extended period of time, the pressure response follows curve 105. The spool exhibits a substantial stiction and requires pressure level A to break free and begin moving. Once movement is initiated, the response becomes flat indicating that a determinable motion can be predicted for a known number of pump cycles. As the spool 22 reaches the end of travel the pressure rises as shown at 106. The pressure is allowed to rise to level D which is a predetermined value greater than original breakout level A, which is the maximum friction/stiction resistance to movement. The spool 22 is cycled between open and closed end stops. The breakout pressure is determined in the direction of desired travel (either open or closed) depending on whether flow is to be increased or decreased through the flow control device. As the spool is cycled several times the spool breaks free at B and follows curve 110. Additional cycles reduce the breakout pressure to C and the spool moves according to curve 115. The spool 22 is cycled between end stops, wearing in the sliding surfaces until successive breakout pressures are repeatable within a predetermined pressure difference, nominally about 100 psi. The processor 60, acting according to programmed instructions, monitors and stores the pressure readings from the pressure sensor 50 and the number of pump cycles from the pump cycle sensor 55 for each cycle of the spool 22. The processor 60 compares the breakout pressure and the number of pump cycles to reach the end stop for each spool cycle to determine if the spool movement cycle must be repeated. The processor 60 controls the valve manifold 60 and the pump 40 to automatically repeat the spool movement cycle until the breakout pressure on successive cycles is within a predetermined difference. The number of pump cycles necessary to move the piston from breakout pressure C to end stop level D on curve 115 is then determined and a first relationship is derived for determining spool travel per pump cycle, or equivalently per volume of fluid. Using this first relationship, the spool 22 can be positioned at intermediate locations between fully opened and fully closed positions. In addition, incremental movement of the spool 22 can be accomplished using the determined first motion relationship as long as the breakout pressure peak remains within the predetermined pressure difference of breakout level C. Once the spool is at a desired location, both hydraulic lines 25 and 30 are closed, thereby hydraulically locking the spool in the desired location. As spool 22 remains in the locked position, the longer term effects of scale buildup, seal draping, fluid degradation, and wear act to again increase the stiction force resisting spool motion so that the breakout pressure will be greater than a predetermined difference than that of the previously derived relationship. Subsequent desired movement of the spool 22 will require a repeat of the wearing in procedure previously described to determine a new second relationship between the spool movement and the required pump cycles or fluid volume. Note that due to permanent wear or damage to the sliding surfaces, it may require a different amount of pressure, compared to the first relationship, to incrementally move the spool 22. Therefore, the second relationship may not be the same as the first relationship. Each time the spool 22 is subsequently moved, after a period at a set position, the initial breakout pressure is compared to the stored previous breakout pressure. If the difference is more than a predetermined value, the wearing in procedure is repeated resulting in a new characterization relationship.

In one preferred embodiment, using the system as described above, the spool 22 is cycled a predetermined number of cycles and the a relationship is determined from the last cycle for spool movement as a function of fluid volume.

Figure 3:
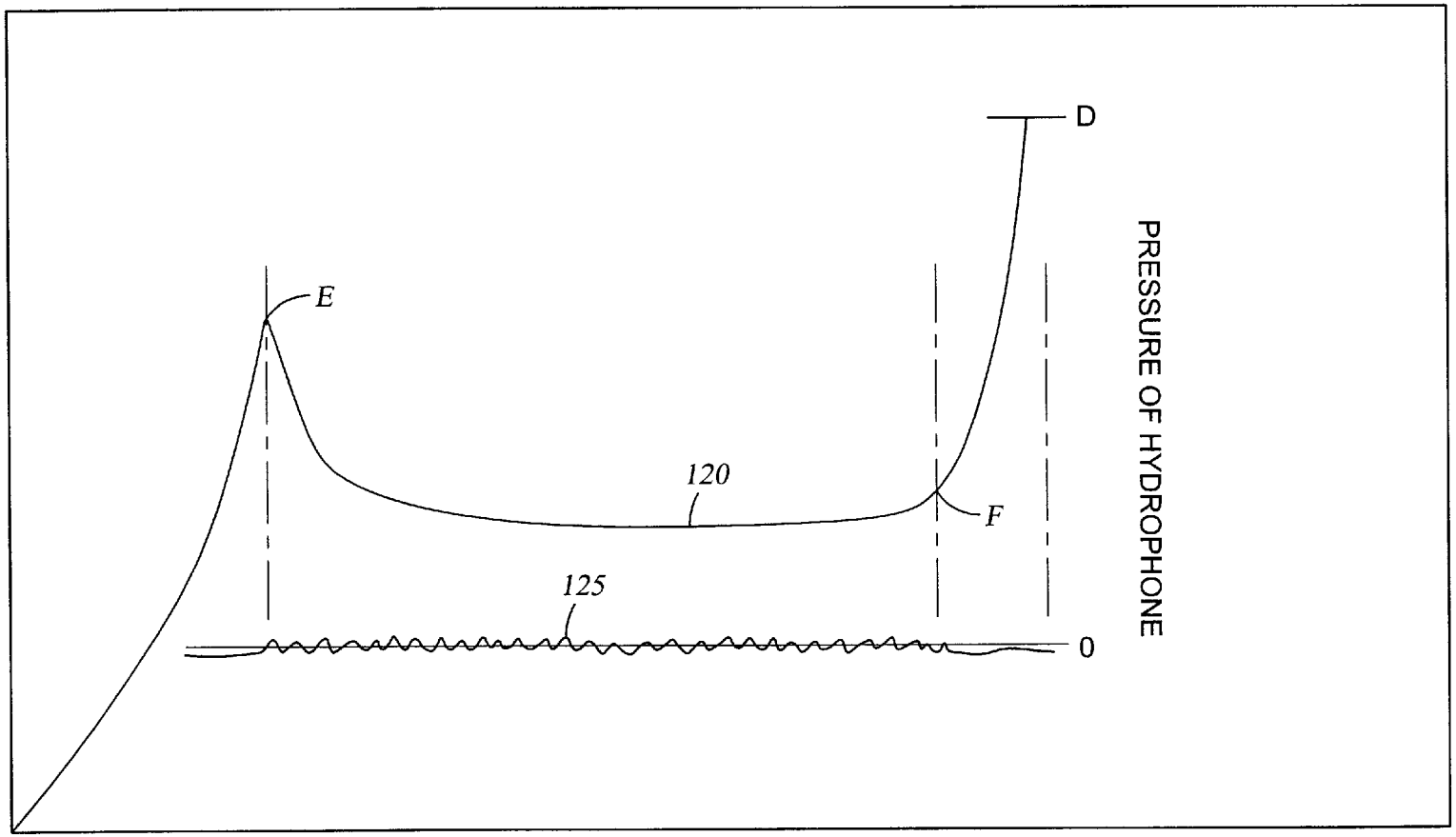

In another preferred embodiment, the previously described system has a hydrophone 43 (see FIG. 1) placed in the reservoir return line 42 between the valve manifold 65 and the reservoir 45. The output signal from hydrophone 43 is fed to processor 60. As is known, a hydrophone is a highly sensitive measuring device for measuring time-varying, also called dynamic, pressure signals, while at the same time being substantially insensitive to the changes in static pressure that take up most of the measuring range of the standard pressure transducer. Instead, the hydrophone essentially measures only the dynamic signal (i.e. pressure pulses) superimposed on the static pressure. Hydrophones are known in the art, and are commercially available and will not be described in further detail. Hydrophones are available with sensitivities on the order of $1\times10^{-4}$ psi. In this preferred embodiment, pump 40 is a reciprocating piston pump that pumps a predetermined amount of fluid with each pump cycle. As is known for this type of pump, each pump cycle has an associated pressure pulse which propagates down the fluid line and impacts the piston (not shown) that drives spool 22 in sliding sleeve 20. For example, to drive spool 22 to the open position, fluid is pumped down opening line 25 and fluid is returned to the reservoir 45, by movement of the piston, in closing line 30. Until the spool 22 is able to overcome the stiction forces previously described, the pressure pulse does not move the piston. When the stiction force is overcome, the pump pressure pulses force the piston and spool 22 to move. The piston movement generates an accompanying pressure pulse in line 30 to the reservoir 45. This pulse is detected by hydrophone 43 and the output signal from hydrophone 43 is fed to processor 60. This is illustrated in FIG. 3, where the hydrophone output 125 shows no signal until the breakout pressure E is applied, at which point, the stiction force is overcome and the piston and spool 22 begin to move. The hydrophone does not sense the slow change in static pressure but only senses the pulses associated with the pump 40. Therefore, the hydrophone 43 can more accurately determine that the piston and spool 22 have begun to move. As each pump pulse moves the piston, an associated pressure pulse is sensed at the hydrophone 43. It is not necessary to detect the characteristics of the pulse, but only the presence or absence of the pulse. At the end of the spool travel F, the hydrophone no longer senses the pump pulses once the spool 22 has reached the stop. Note that the hydrophone indicates the spool 22 is at the end of travel as soon as the spool 22 hits the end stop, thereby no longer moving and creating pulses in the line 30. In contrast, the opening line pressure signal must rise to level D before the end of travel is determined. In this preferred embodiment, the processor 60, acting according to programmed instructions, generates a third relationship between the number of pump pulses and the spool 22 movement between end stops, using the hydrophone 43 signal to indicate the beginning and end of spool 22 travel. Note that while the spool 22 movement in one direction has been described, the same technique is applicable to the spool 22 movement in the opposite direction by supplying fluid to closing line 30 and allowing return fluid from opening line 25 to return to the reservoir 45.

In another embodiment referring to FIG. 1, a flow meter 44 is inserted in the hydraulic return line 42 for measuring fluid flow in the return line. As is known in the art, the hydraulic lines 25, 30 expand due to internal pressure. While the unit expansion is relatively small, the expansion volume over the length of the line is typically of the same order, or even larger, than the actuating volume driving the spool 22 in sliding sleeve 20. Therefore, changes in hydraulic pressure in the line 25 can mask a volume of fluid added to the line 25 to move the position of the spool 22, thereby causing uncertainty in the position of the spool 22. To obviate this problem, the following method is used. Initially, both the opening line 25 and the closing line 30 are pressured to the same predetermined level. To move the spool 22 in the opening direction, a volume of fluid is bled from the closing line 30 and is measured by the flow meter 44. This reduces the pressure in the closing line 30 below the pressure in the opening line 25. The pressure on the opening line side 25 of the piston (not shown) is greater than the pressure on the closing line 30 side moving the piston, and the attached spool 22, until the pressures are equalized. The closing line 30 is blocked and the opening line 25 is then pressurized to the original predetermined level while measuring the volume of fluid added to the opening line 25. This restores the fluid volume in each hydraulic line to its initial value. Alternatively, opening line 25 is pressurized until the pressure in closing line 30 is returned to the predetermined level. Note that the pressure in opening line 25 may then exceed the predetermined pressure. The opening line pressure is then adjusted to the predetermined pressure. The difference in volume pumped into the opening line 25 from the volume bled from the closing line 30 is determined and is related to the movement of the piston and spool 22 by the swept volume of the piston. This cycling may be repeated to characterize the motion of the spool 22 as a function of volume pumped at a predetermined pressure.

While the systems and methods are described above in reference to production wells, one skilled in the art will realize that the system and methods as described herein are equally applicable to the control of flow in injection wells. In addition, one skilled in the art will realize that the system and methods as described herein are equally applicable to land and seafloor wellhead locations.

The foregoing description is directed to particular embodiments of the present invention for the purpose of illustration and explanation. It will be apparent, however, to one skilled in the art that many modifications and changes to the embodiment set forth above are possible. It is intended that the following claims be interpreted to embrace all such modifications and changes.

What is claimed is:

1. A system for controlling a downhole flow control device, comprising:

a. a hydraulically actuated flow control device in a tubing string in a well, said flow control device having a movable element for controlling a downhole formation flow;

b. a hydraulic system hydraulically coupled to said hydraulically actuated flow control device for supplying hydraulic fluid to said hydraulically actuated flow control device;

c. at least one first sensor for detecting at least one parameter of interest related to a volume of hydraulic fluid supplied to said hydraulically actuated flow control device and generating a first signal related thereto;

d. at least one pressure sensor for determining a hydraulic fluid supply pressure and generating a second signal related thereto; and e. a processor receiving said first signal and said second signal and acting according to programmed instructions to generate a relationship between a position of said moveable element and said volume of supplied hydraulic fluid, said processor acting according to programmed instructions to control said hydraulic system to position said moveable element at a predetermined position according to said relationship.

2. The system of claim 1, wherein said well is one of (i) a production well and (ii) an injection well.

3. The system of claim 1, wherein the hydraulically actuated flow control device is one of (i) a sliding sleeve; (ii) a downhole choke; and (iii) a downhole control valve.

4. The system of claim 1, further comprising:

i. at least one opening line hydraulically coupling said hydraulic system to said hydraulically actuated device to drive said moveable element in a first opening direction; and ii. at least one closing line hydraulically coupling said hydraulic system to said hydraulically actuated device to drive said moveable element in a second closing direction.

5. The system of claim 1, wherein the hydraulic system comprises:

i. a pump for supplying hydraulic fluid to a pump discharge line; and ii. a remotely operable valve manifold for directing hydraulic fluid from said pump discharge line to at least one of (i) said opening line and (ii) said closing line.

6. The system of claim 5, wherein the pump is a positive displacement pump.

7. The system of claim 1, wherein the at least one parameter of interest is at least one of (i) pump cycles and (ii) hydraulic fluid flow rate.

8. The system of claim 1, wherein the at least one sensor is at least one of (i) a pump cycle sensor and (ii) a positive displacement flow sensor.

9. The system of claim 5, wherein the processor comprises:

i. at least one circuit for powering and interfacing with said at least one first sensor and said at least one pressure sensor;

ii. at least one circuit for controlling said pump; and iii. at least one circuit for controlling said valve manifold.

10. A system for controlling a downhole flow control device, comprising:

a. a hydraulically actuated flow control device in a tubing string in a well, said flow control device having a movable element for controlling the downhole formation flow;

b. a hydraulic system hydraulically coupled to said hydraulically actuated flow control device for supplying hydraulic fluid to said hydraulically actuated flow control device;

c. at least one first sensor detecting at least one parameter of interest related to a volume of hydraulic fluid supplied to said hydraulically actuated flow control device and generating at least one first signal related thereto;

d. at least one pressure sensor for determining a hydraulic fluid supply pressure and generating at least one second signal related thereto;

e. a hydrophone disposed in a hydraulic line detecting a pressure pulse in response to movement of said moveable element and generating a third signal in response thereto; and f. a processor receiving said first signal, said second signal, and said third signal and acting according to programmed instructions to generate a relationship between a position of said moveable element and said volume of supplied hydraulic fluid, said processor adapted to control said hydraulic system to position said moveable element at a predetermined position according to said relationship.

11. The system of claim 10, wherein said well is one of (i) a production well and (ii) an injection well.

12. The system of claim 10, wherein the hydraulically actuated flow control device is one of (i) a sliding sleeve; (ii) a downhole choke; and (iii) a downhole control valve.

13. The system of claim 10, further comprising:

i. at least one opening line hydraulically coupling said hydraulic system to said hydraulically actuated device to drive said moveable element in a first opening direction; and ii. at least one closing hydraulic line hydraulically coupling said hydraulic system to said hydraulically actuated device to drive said moveable element in a second closing direction.

14. The system of claim 10, wherein the hydraulic system comprises;

i. a pump for supplying hydraulic fluid to a pump discharge line; and ii. a remotely operable valve manifold for directing hydraulic fluid from said pump discharge line to at least one of (i) said opening hydraulic line and (ii) said closing hydraulic line.

15. The system of claim 14, wherein the pump is a positive displacement pump.

16. The system of claim 10, wherein the at least one parameter of interest is at least one of (i) pump cycles and (ii) hydraulic fluid flow rate.

17. The system of claim 10, wherein the at least one first sensor is at least one of (i) a pump cycle sensor and (ii) a positive displacement flow sensor.

18. The system of claim 10, wherein the processor includes;

i. at least one circuit for powering and interfacing with said at least one first sensor, said hydrophone, and said at least one pressure sensor; and ii. at least one circuit for controlling said valve manifold.

19. A method for control of a hydraulically actuated downhole flow control device, comprising;

a. cycling a moveable element in the hydraulically actuated downhole flow control device in a first direction and a second opposite direction;

b. determining a breakout pressure for each actuation cycle using at least one pressure sensor;

c. repeating said cycling until a predetermined criterion is met;

d. using a processor to generate a relationship characterizing the movement of said moveable element as a function of a pumped fluid volume; and e. using said processor to control the supply of a fluid volume required according to said relationship to move said moveable element to a predetermined position.

20. The method of claim 19, wherein the predetermined criterion is one of (i) until the breakout pressure on successive cycles is within a predetermined difference while measuring the pumped fluid volume for each cycle and (ii) until a predetermined number of cycles.

21. The method of claim 19, wherein the at least one pressure sensor is at least one of (i) a total pressure sensor and (ii) a hydrophone.

22. A method for control of a hydraulically actuated downhole flow control device, comprising;

a. supplying hydraulic fluid to an actuator cooperatively coupled to a moveable element in the hydraulically actuated downhole flow control device through a first line and a second line;

b. pressuring the first line and the second line to the same predetermined pressure;

c. bleeding a first measured volume of hydraulic fluid from said second line causing said actuator to move said moveable element;

d. supplying a second measured volume of hydraulic fluid to said first line until said first line is at said predetermined pressure;

e. determining a volume difference between said second measured volume and said first measured volume and using a processor to generate a relationship between said volume difference and said moveable element movement; and f. using said relationship to move said moveable element to a predetermined position.

23. The method of claim 22, wherein said first line is one of an opening line and a closing line, and said second line is an other of said opening line and said closing line.

24. A method for control of a hydraulically actuated downhole flow control device, comprising;

a. supplying hydraulic fluid to an actuator cooperatively coupled to a moveable element in the hydraulically actuated downhole flow control device through a first line and a second line;

b. pressuring the first line and the second line to the same predetermined pressure;

c. bleeding a first measured volume of hydraulic fluid from said second line substantially equal to a spool displacement volume required to move said spool to a predetermined position;

d. supplying a second measured volume of hydraulic fluid to said first line until said second line is at said predetermined pressure;

e. adjusting a pressure in said first line to said predetermined pressure;

f. determining a volume difference between said second measured volume and said first measured volume and using a processor to generate a relationship between said volume difference and said moveable element movement; and using said relationship to move said moveable element to said predetermined position.

25. The method of claim 24, wherein said first line is one of an opening line and a closing line, and said second line is an other of said opening line and said closing line.

* * * * *